United States Patent [19]

Noba et al.

[11] 3,944,774

[45] Mar. 16, 1976

[54] ELECTRIC SWITCH HAVING A SEALED CASING

[75] Inventors: Motoi Noba, Toyota; Hatsuyoshi Yoshida, Toyoake, both of Japan

[73] Assignees: Toyota Jidosha Kogyo Kabushiki Kaisha, Toyota; Tokai Rika Denki Seisakusho K.K., both of Japan

[22] Filed: Aug. 7, 1974

[21] Appl. No.: 495,430

[30] Foreign Application Priority Data

Aug. 25, 1973 Japan..... 48-100042 [U]

[52] U.S. Cl...... 200/302; 200/306

[51] Int. Cl.[2]..... H01H 9/04

[58] Field of Search..... 200/306, 150 H, 302

[56] References Cited

UNITED STATES PATENTS

| | | | |
|---|---|---|---|
| 1,846,841 | 2/1932 | Burnham | 200/150 H X |
| 1,916,717 | 4/1933 | De Giers | 200/302 |
| 2,150,859 | 3/1939 | Gibson et al. | 200/306 X |
| 2,230,277 | 2/1941 | Volker et al. | 200/302 |
| 3,336,457 | 8/1967 | Julian et al. | 200/306 |

*Primary Examiner*—James R. Scott
*Assistant Examiner*—William J. Smith
*Attorney, Agent, or Firm*—Stevens, Davis, Miller & Mosher

[57] ABSTRACT

An electric switch having a sealed casing or a closed type switch wherein a breather hose has its one end opened to the interior of a closed contact chamber, so that the breathing action of the contact chamber due to its temperature change is made through the breather hose. An opening at the other end of the breathing hose is located in an outside atmosphere of good condition, whereby air of high humidity is prevented from intruding into the contact chamber.

8 Claims, 3 Drawing Figures

ELECTRIC SWITCH HAVING A SEALED CASING

The present invention relates to an electric switch having a sealed casing or a closed type switch which is rendered waterproof.

Where a prior-art closed switch is mounted on a place of bad circumstances, a gap appears at a tightly fastened part due to vibration, etc. As the result, highly humid air is introduced into a contact chamber by the breathing action which is ascribable to the difference in temperature between the interior and exterior of the contact chamber. It is accordingly often the case that the surface of a contact portion gradually forms an oxide film on account of dew formation and that inferior contact arises. This leads to such disadvantages of the prior art that the performance of the switch unit is conspicuously spoilt and that the durable years are shortened.

An object of the present invention is to provide a switch which is perfectly closed so that quite no moisture may permeate into a contact chamber even under very severe circumstances.

Another object is to provide a switch which, even when a breathing action due to a temperature change in a contact chamber arises, is reliably prevented from bringing about inferior contact or leading to an unserviceable state on account of the intrusion of highly humid air etc. and the subsequent formation of an oxide film in the surface of a contact portion.

Other features and advantages of the invention will be apparent from the following description taken in connection with the accompanying drawings, in which.

Figure 1:
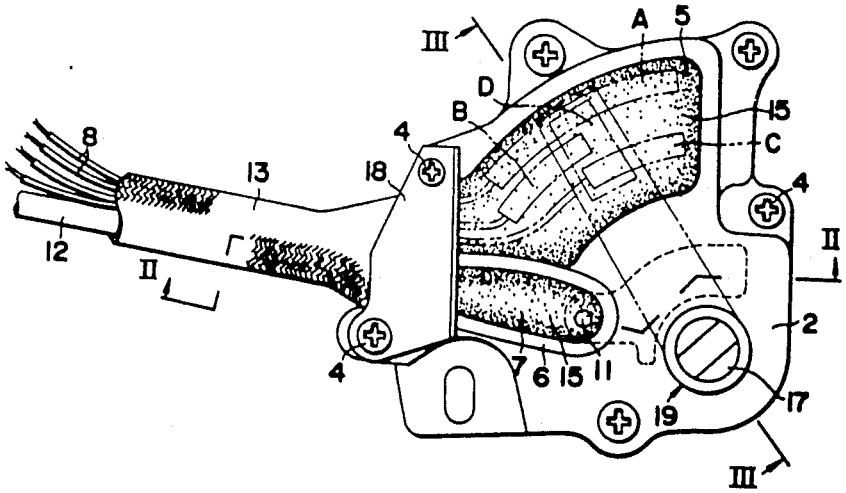
FIG. 1 is a plan view of an electric switch having a sealed casing or a closed switch provided with a breather hose according to the present invention.
Figure 2:
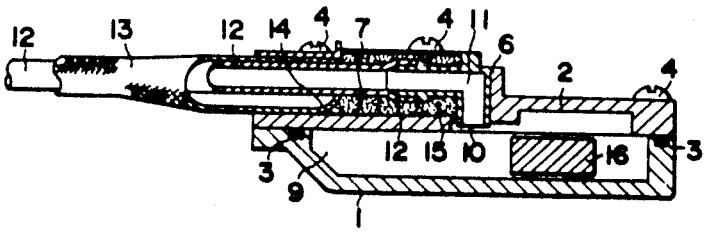
FIG. 2 is a sectional side elevation taken along a line II — II in FIG. 1.
Figure 3:
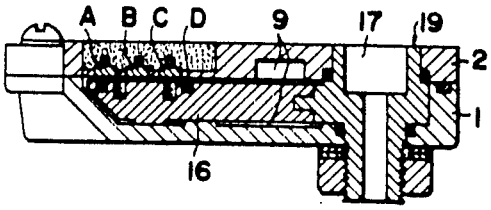
FIG. 3 is a sectional side elevation taken along a line III — III in FIG. 1.

On the upper surface of a switch case 1 formed into a predetermined shape, there is placed switch insulator 2 which is the cover of the switch case. Defined inside the switch case 1 is a contact chamber 9, in which a movable contact (D) adapted to turn therein is disposed.

The switch insulator 2 is made of a synthetic resin material, and is formed into the same external shape as that of the switch case 1. In the switch insulator 2, the trains of fixed contacts (A), (B) and (C) are integrally buried.

The contact surfaces of the fixed contacts (A), (B) and (C) are enclosed, together with the movable contact, into the contact chamber by placing the switch case 1 and the switch insulator 2 one over the other. The movable contact and the fixed contacts are in such manner that a predetermined position of the fixed contacts (A), (B) and (C) can be selected by turning the movable contact (D) within the contact chamber 9.

At the peripheral edge portion of the lap surfaces of and between the switch case 1 and the switch insulator 2, a seal member 3 such as O-ring is disposed. The switch case 1 and the switch insulator 2 are integrally and tightly fastened at several predetermined places by a plurality of screws 4.

The switch insulator 2 has a depressed portion 5 which is expanded substantially fanwise in plan on the upside thereof, and a concave portion 7 which is oval in plan and whose peripheral edge portion is surrounded by a small and rising wall 6.

Within the depressed portion 5, the fore end parts of a plurality of lead wires 8 formed into predetermined lengths are secured to the joint parts of the respective trains of the fixed contacts (A), (B) and (C) by such means as brazing.

On the other hand, the concave portion 7 is provided at one side end part thereof with a wide communicating hole 10 which communicates to the interior of the contact chamber 9 defined inside the switch case 1. One end of a hollow cylindrical elbow 11 which is bent into an inverted-L shape in section is secured to the communicating hole 10 in the communicating state.

At the other end of the elbow 11, a breather hose 12 is mounted which has a predetermined length for bringing the contact chamber 9 into communication with the atmospheric air. The breather hose 12 and the lead wires 8 extending into the depressed portion 5 are inserted in a tube 13 which is made of material having thermal resistance, electric insulation, water proof and wear proof.

The lead wires 8 within the depressed portion 5 including the fore end part 14 of the tube 13 and the elbow 11 as well as the breather hose 12 located within the concave portion 7 are integrally buried and hardened by an epoxy resin 15 at their respective positions on the upside of the switch insulator 2.

The tube 13 in which the lead wires 8 and the breather hose 12 are inserted is made so long as to cover the lead wires 8 and the breather hose 12 to the extent that they are not splashed with water. In case of, for example, an automobile, the opening of the breather hose 12 as is remote from the elbow 11 is situated at an appropriate position at which it is not directly exposed to an outside atmosphere of bad condition as in the car room.

Numeral 16 designates a turning contact bar which has the movable contact (D) turning within the contact chamber 9 about a shaft portion 19 and serving to select a predetermined position of the fixed contacts. Numeral 17 denotes a mounting portion for a control rod for controlling the turning contact bar 16. Shown at 18 is a keeper fixture for the tube 13.

The present invention is constructed as stated above. In the switch having the contact chamber 9 which is closed by the switch case 1 and the switch insulator 2, the breather hose 12 of the predetermined length is connected and arranged so as to have its one end opened into the contact chamber 9, whereby the inhalation of the outside air as based on the breathing action of the contact chamber 9 attributable to a temperature change in the chamber is made thrgough the breather hose 12. Therefore, the intrusion of air of high humidity or with much fine dust in the outside atmosphere of bad condition can be reliably and readily checked merely by disposing the other opening end of the breather hose 12 at a suitable place. In addition, the enhancement of water proof is easily achieved, and various operative parts can be accurately operated over a long term.

What is claimed is:

1. An electric switch which comprises:

a movable contact and fixed contacts;

a casing for enclosing said contacts;

said casing defining a chamber in which said movable contact is disposed, and including a cover to render the same waterproof, the outside wall of said cover defining a cavity having apertures therein through which said fixed contacts are installed with their contact surfaces extending into said chamber;

a plurality of lead wires disposed in said cavity of said cover and connected to said fixed contacts;

a compound packed in said cavity to ensure the sealed state of said chamber;

and means to conduct atmospheric air into and from said casing from a region remote from said casing.

2. An electric switch as defined in claim 1, wherein said outside wall of said cover includes a second cavity, said means to conduct atmospheric air passing through said second cavity and said compound being packed in said second cavity thereby to fix said means in position.

3. An electric switch as defined in claim 2, wherein said cavity through which said fixed contacts are installed is fanwise in plan on the upside of said cover, and said second cavity is oval in plan and has its peripheral edge surrounded by a small retaining wall.

4. An electric switch as claimed in claim 1, wherein said movable contact comprises a bar, means mounting said bar for sliding movement within said chamber, and a contact fixed to said bar for coaction with said fixed contacts.

5. An electric switch as defined in claim 4, wherein the depth of said chamber is substantially equal to the height of said bar of said movable contact.

6. An electric switch as defined in claim 1, further comprising a tube for sheathing and covering said lead wires and said means.

7. An electric switch as defined in claim 1, wherein said means comprises a hose and a hollow cylindrical elbow L shape in section, connected at one end thereof to said hose, the other end being open into said casing.

8. An electric switch having a sealed casing defined in claim 1, wherein said switch case is secured to a housing of a speed change gear, and it is arranged so that said movable contact may interlock with a shift lever for a speed change operation.

* * * * *